US008297173B1

(12) United States Patent
Teetzel et al.

(10) Patent No.: US 8,297,173 B1
(45) Date of Patent: Oct. 30, 2012

(54) MODULAR WEAPON VIDEO DISPLAY SYSTEM

(75) Inventors: James W. Teetzel, York, ME (US); Justin D. Harris, Dover, NH (US); Linwood B. Davis, Londonderry, NH (US); Marvin S. Carter, Rochester, NH (US); Ferdinand N. Ahlberg, Hopkinton, NH (US); Dominic R. Goupil, Kittery, ME (US)

(73) Assignee: Wilcox Industries Corp., Newington, NH (US)

( * ) Notice: Subject to any disclaimer, the term of this patent is extended or adjusted under 35 U.S.C. 154(b) by 882 days.

(21) Appl. No.: 11/972,481

(22) Filed: Jan. 10, 2008

Related U.S. Application Data

(60) Provisional application No. 60/879,777, filed on Jan. 10, 2007, provisional application No. 60/879,897, filed on Jan. 11, 2007.

(51) Int. Cl.
*F41G 1/00* (2006.01)
*F41G 5/06* (2006.01)

(52) U.S. Cl. ..... 89/41.17; 89/41.05; 42/111; 42/115; 42/119; 42/131

(58) Field of Classification Search ..... 89/41.05, 89/41.17; 42/111, 115, 119, 120, 122, 141
See application file for complete search history.

(56) References Cited

U.S. PATENT DOCUMENTS 7,255,035 B2 * 8/2007 Mowers ..... 89/41.05
7,661,348 B2 * 2/2010 Murello ..... 89/6.5
7,810,273 B2 * 10/2010 Koch et al. ..... 42/111
2008/0107414 A1 * 5/2008 Showalter ..... 396/429
2010/0154276 A1 * 6/2010 Kim ..... 42/90

FOREIGN PATENT DOCUMENTS

WO WO 2006097310 A1 * 9/2006

OTHER PUBLICATIONS

English translation of WO 2006097310 A1 published Sep. 21, 2006.*

* cited by examiner

*Primary Examiner* — Lin Ye
*Assistant Examiner* — John H Morehead, III
(74) *Attorney, Agent, or Firm* — McLane, Graf, Raulerson & Middleton, Professional Association

(57) ABSTRACT

An improved modular video display system for a weapon having a video display module that can accommodate multiple camera inputs. The video display module contains a video control panel and human-viewable display screen, which enables the operator to switch between viewing and controlling a thermal sight and a left and right rotating camera. The video display module and cameras are powered by a power supply, which is electrically coupled to the weapons accessory devices, once each device is mounted on the modular rails. The cameras are connected to the video display module and the weapons operator may select either a thermal display using the thermal sight or an image display of the left or right using the left and right rotating camera. The control panel enables the operator to personalize the display screen in order to best suit their current situational needs with controls for camera select, reticle style, reticle color, reticle intensity, bore sight keys, black hot/white hot image select, digital zoom, and display brightness. In conjunction with the modular video display system additional accessory devices may be used, such as laser sights, spotting scopes, and handgrip units.

17 Claims, 8 Drawing Sheets

MODULAR WEAPON VIDEO DISPLAY SYSTEM

RELATED APPLICATIONS

This application claims the priority benefit under 35 U.S.C. §119(e) of U.S. provisional patent application Nos. 60/879,777 filed Jan. 10, 2007; and 60/879,897 filed Jan. 11, 2007. The aforementioned applications are herein incorporated by reference in their entireties.

BACKGROUND

The present disclosure relates to a modular weapon video display system, useable with a floating rail system, which may include an accessory mount interface such as a Picatinny type mounting rail structure (e.g., as per standard MIL-STD-1913) of the type commonly employed with a military or tactical firearm. The rail system may be used for attaching all manner of accessories, such as thermal sight systems, rotating left and right camera systems, video display systems, quick changing power supplies, optical scopes, tactical flashlights, vertically extending handgrips, or other weapon-mounted accessories. The floating rail system herein may be as described in U.S. patent application Ser. No. 11/972,426 filed Jan. 10, 2008 and incorporated herein by reference in its entirety.

Conventional weapon video display systems require additional equipment for their use, such as a helmet-mounted video display system to be worn by the operator. In addition conventional weapon video display systems typically only have one type of camera. Thus, it would be desirable to provide a video display system that would not require the operator to carry additional equipment while in combat. In addition it would be desirable to have multiple camera types compatible with the same display system and an easy mechanism for the operator to switch between multiple camera types. The present device contemplates an improved video display system, which overcomes both of the above-referenced limitations and others.

SUMMARY

The present disclosure relates to an improved modular video display system for a weapon which can accommodate multiple camera inputs. This video display system is adapted for use with a weapon mount interface such as a Picatinny mounting rail structure. The video display system includes a video display module containing a video control panel and human-viewable display screen. The video display module enables both a thermal sight and a left and right rotating camera to be selectively viewable via the display screen. The video control panel enables the operator to select between the thermal and left and right rotating cameras and to control the output displayed on the display screen. The cameras and video display module are powered by a removably attachable power supply. Electrical couplings and internal floating rail system wiring enables power and the camera images to be transmitted between the power supply, cameras, and video display module.

One advantage of the video display system in accordance with the present disclosure is that it enables the operator of the weapon to have an enhanced situational awareness. The enhanced situational awareness is provided by the operator being able to use their weapon as an extension of themselves to see around corners or over obstructions without placing themselves in danger.

Another advantage of the presently disclosed video display system is its ability to allow the operator to aim at targets while remaining covered and concealed. With the addition of the cameras and display screens the operator's vision can be improved and enable them to use additional visual guides to aim at a target while maintaining their own safety.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
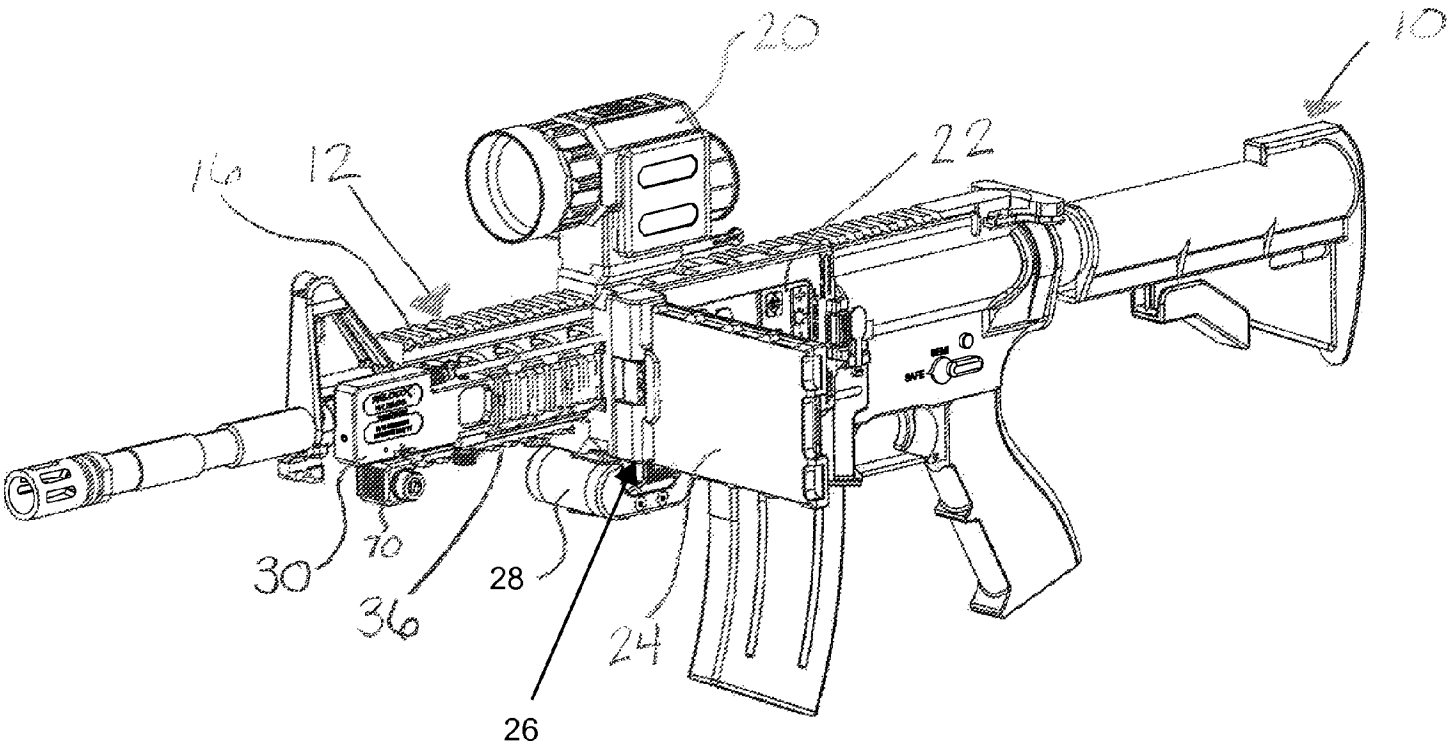
FIG. 1 is an isometric view of a firearm using a floating rail system with a thermal sight, a video display system, a left and right rotating camera, and a power supply attached.
Figure 3:
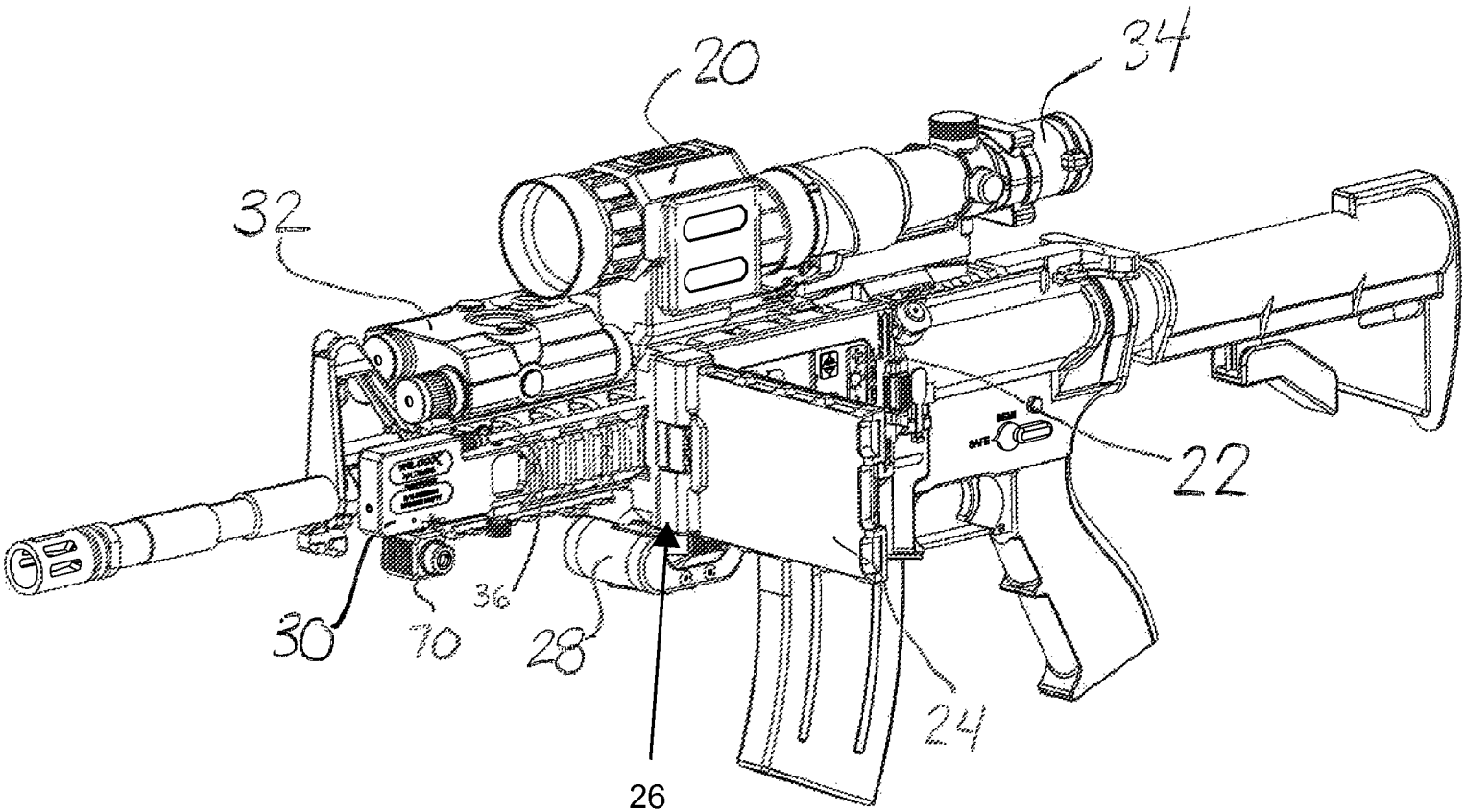
FIG. 3 is an isometric view of a firearm using a floating rail system with an attached laser sight, thermal sight, spotting scope, left and right rotating camera, power supply, and video display module.

Referring now to FIGS. 1 and 3, the modular video display module 26 is shown attached to firearm 10 which contains a floating rail system 12, which may include Picatinny mounting rail structure (e.g., as per standard MIL-STD-1913). Floating rail system 12 is attached to firearm 10 via a rear clamp (not shown) and a chassis 14, which extends out from the rear clamp. Modular rails 16 are attached to chassis 14 and provide a surface for all accessory devices to be attached, as described in U.S. provisional patent application No. 60/879,777 filed Jan. 10, 2007 and U.S. provisional patent application No. 60/879,879 filed Jan. 11, 2007, or U.S. patent application Ser. No. 11/972,426, filed Jan. 10, 2008, which applications are herein incorporated by reference in their entireties Such accessory devices may include a thermal sight or camera 20, video display modules 26, power supplies 28, left and right rotating camera modules 30, laser sights 32, and spotting scopes 34.

The modular video display selectively displays video images from one or more video acquisition sources, such as the weapon-mounted thermal sight 20 and the left and right rotating camera 30 on video display screen 24 appearing in FIGS. 1 and 3. Video display screen 24 and video control panel 22 compose the video display module 26 and control panel 22 enables the operator to alter the images that appear on display screen 24 to better aid in the use of the weapon, e.g., during combat, tactical operation, or the like. The power supply 28 may also be used to provide power to other weapon mounted accessories, e.g., accessories which do not have a dedicated power supply. The display screen 24 is preferably an LCD screen although other display types are contemplated.

Figure 2:
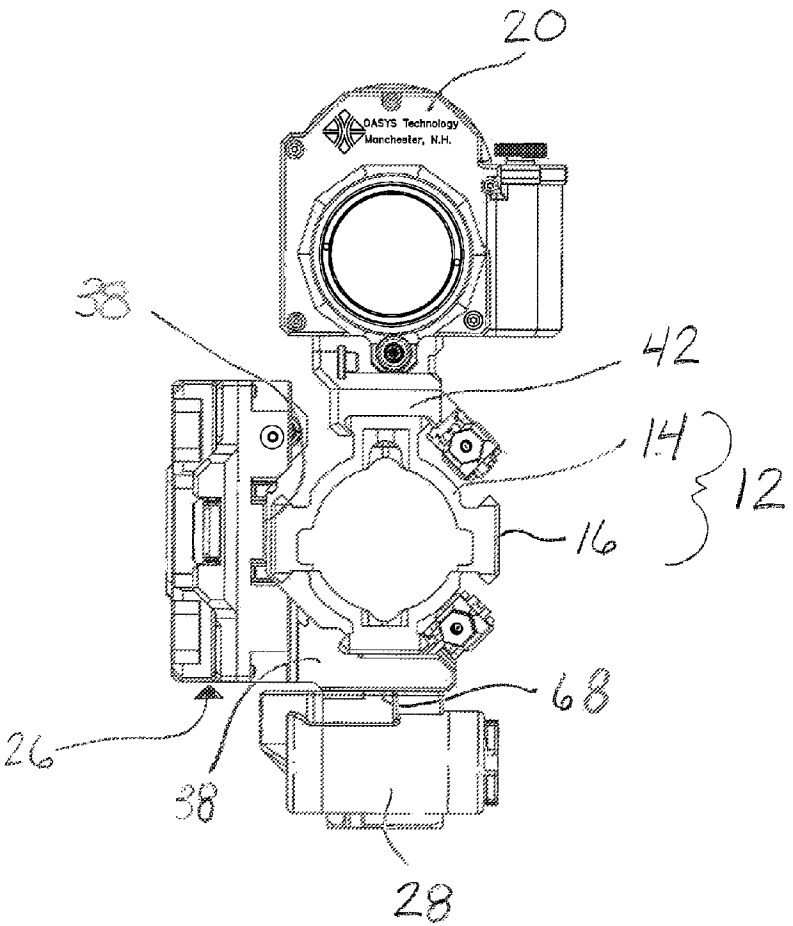
FIG. 2 is a rear view of the floating rail system with an attached thermal sight, power supply, and a closed video display module.

Referring now to FIG. 2, a rear view of floating rail system 12 shows the attachment interaction between the modular rails 16 and the thermal sight 20, video display module 26, and power supply 28 accessory devices. Thermal sight 20 may be secured to the floating rail system 12 via a three point fastener as described in U.S. provisional application Nos. 60/855,928 filed Nov. 1, 2006, 60/879,823 file Jan. 10, 2007, 60/920,107 filed Mar. 26, 2007, or U.S. patent application Ser. No. 11/933,887 filed on Nov. 1, 2007, which applications are herein incorporated by reference in their entireties. In this manner, the thermal sight 20 may maintain its bore sight when removed temporarily from the rail interface, e.g., for hand held use. Video display module 26 may be secured to the floating rail system 12 via a video display mounting member 38, best seen in FIGS. 5 and 6.

Figure 7:
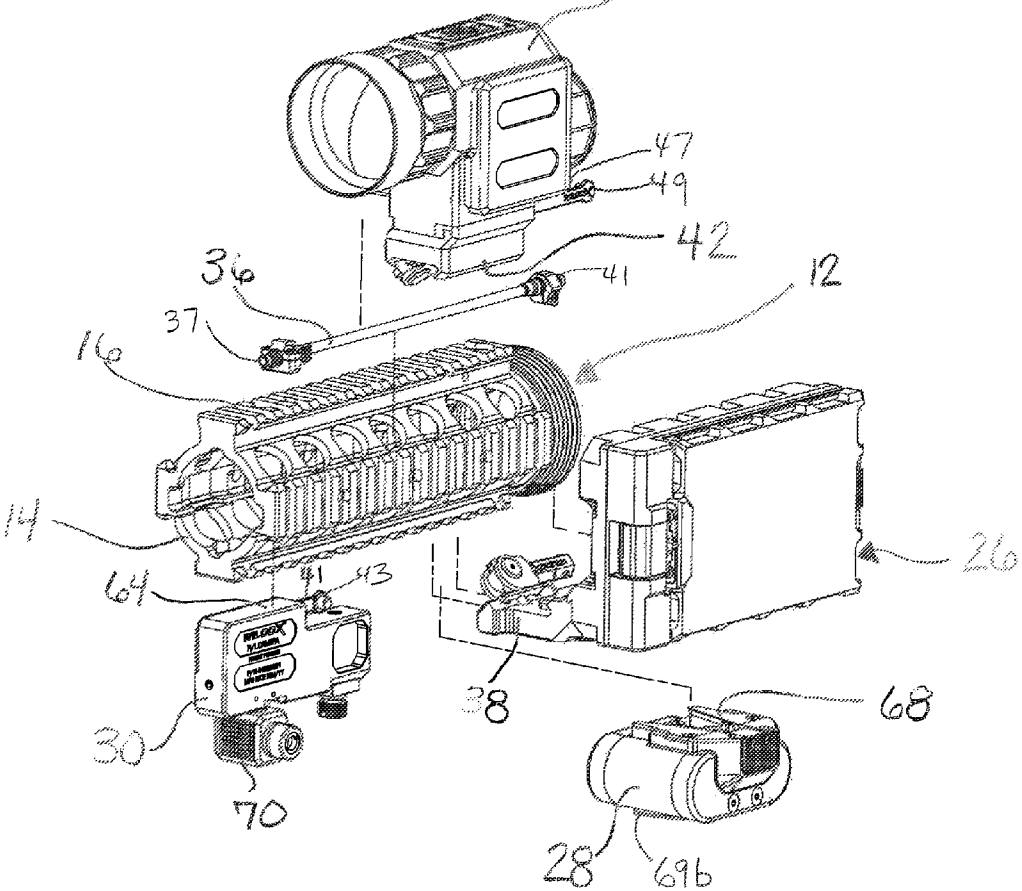
FIG. 7 is an exploded isometric view of the floating rail system and unattached thermal sight, video display module, power supply, left and right rotating camera, and cable assembly.

The power supply 28 may be releasably secured to the video display module 26 via a power supply mounting member 68 as best viewed in FIG. 7. The power supply mounting member 68 is of a sliding shoe type, which removably engages a mating connector foot 69*a* on the video display module 26. The power supply module 28 may also have a connector foot 69*b* for removably attaching a like power supply module and providing a parallel electrical connection for longer battery life. Optionally, the power supply 28 can be attached to a desired position on the floating rail 12 through the use of a rail grabber adapter with pass through electrical conductors to couple the battery contacts on the power supply 28 to power conductors on the floating rail 12. Alternatively, the power supply unit may be of a quick change, bayonet-mount type shown and described in U.S. patent application Ser. No. 11/591,886 filed, Nov. 1, 2006, the entire contents of which are incorporated by reference. Power supply 28 interacts with the power conductors located on the floating rail system 12 to carry power to accessory devices located on the floating rail 12 as shown and described in U.S. patent application Ser. No. 11/972,426 filed on Jan. 10, 2008, the entire contents of which are herein incorporated by reference.

The left and right rotating camera module 30 may be secured to floating rail system 12 via a left and right camera mounting member 64, as best viewed in FIGS. 7 and 10-12. The left and right camera module 30 is secured to the forward end of the floating rail system 12 and is coupled to the video display module 26 via cable assembly 36 as seen in FIGS. 1 and 3. In a preferred embodiment, the video display module includes a video output for outputting video images from one or both of the cameras to a selected source, e.g., a video recorder, an additional display or monitor such as a helmet-mounted or wearable display and so forth. The addition of the left and right camera module 30 enables the operator to use the weapon to look around corners or if used like a periscope to look over obstacles, thus providing the operator with enhanced situational awareness.

The cable 36 has a first connector end 37 which connects to an output connector 39 on the left and right camera module 30 and a second connector end 41 which connects to an input connector 39 on the weapon video display module 26. A connector plug 43 covers the output connector 39 when not in use.

A second cable, not shown, similarly connects an output connector 47 on the thermal sight 20 to the input connector 40 on the video display module 26. Output connector 47 likewise is shown with a plug 49 for protecting the connector 47 when not in use.

In certain embodiments, one or both of the connectors 39 and 40 are multi-pin connectors which allow the connectors to also be used as output connectors to a video recorder device, display monitor, or the like, incorporated in existing ports 39 and/or 40. Alternatively, a serial communications port may be provided. The serial port can be used for communication with a range finder module or a GPS module. The serial port can also be utilized to update the system Firmware or transmit compressed video images. A separate video output connector cable may be provided.

Figure 6:
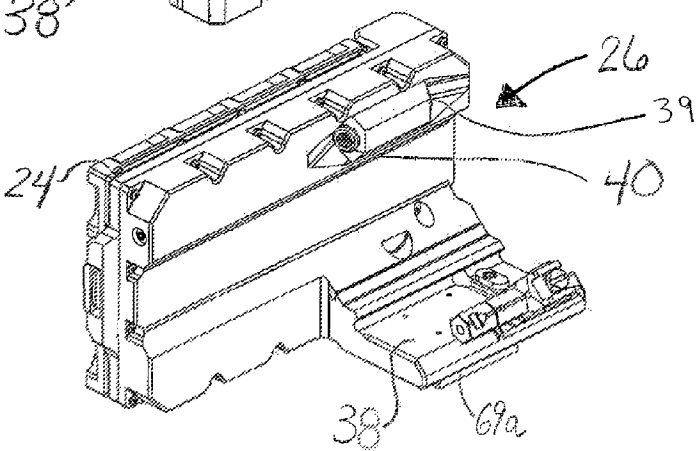
FIG. 6 is a left isometric view of a closed video display module.
Figure 11:
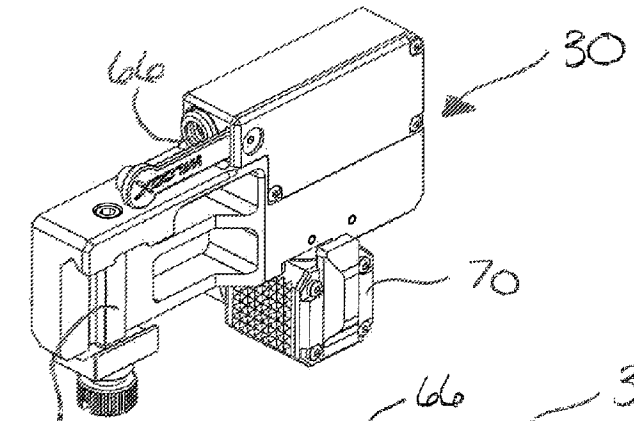
FIG. 11 is a left isometric view of the left and right rotating camera with the camera in the right position.
Figure 12:
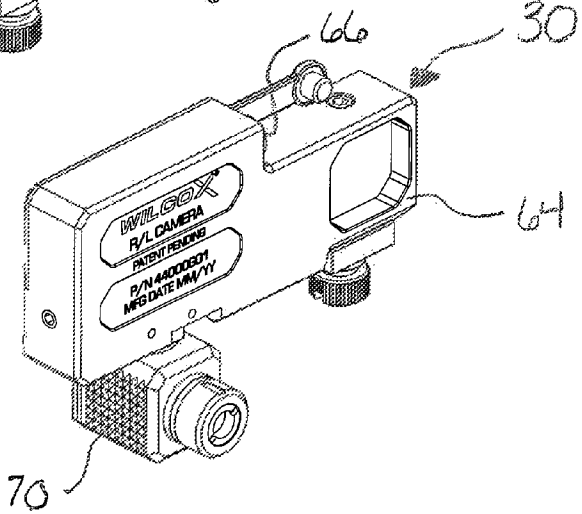
FIG. 12 is a right isometric view of the left and right rotating camera with the camera in the right position.
Figure 10:
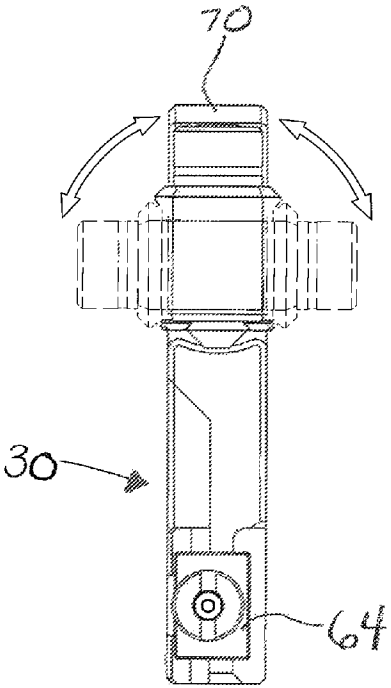
FIG. 10 is a bottom view of the left and right rotating camera showing the rotation of the left and right camera.

The left and right rotating camera module 30 is powered by the power supply 28 through the cable connecting left and right camera module 30 to video display module 26, although alternatively the use of the power conductors on the floating rail 12 is also contemplated. Control signals for controlling the operation of camera 30 are sent to camera 30 from the video control panel 22 and the images from the left and right rotating camera 30 are output to the video display module 26 via the cable assembly 36 and the video signal input connector 39, as best seen in FIGS. 6 and 7. The left and right rotating camera 30 may be a daytime camera or a visible light, low lux camera to allow imaging of visible light in low light conditions. The left and right camera 70 is pivotally attached to the left and right rotating camera module 30 enabling the camera 70 to be rotated to face either left, right, or straight ahead, or other desired angular orientations with respect to the axis of the barrel of the weapon 10, as best seen in FIGS. 10-12. The pivotal attachment of left and right camera 70 enables the operator to easily rotate the camera 70 to face the desired direction to provide the operator with enhanced situational awareness.

Figure 5:
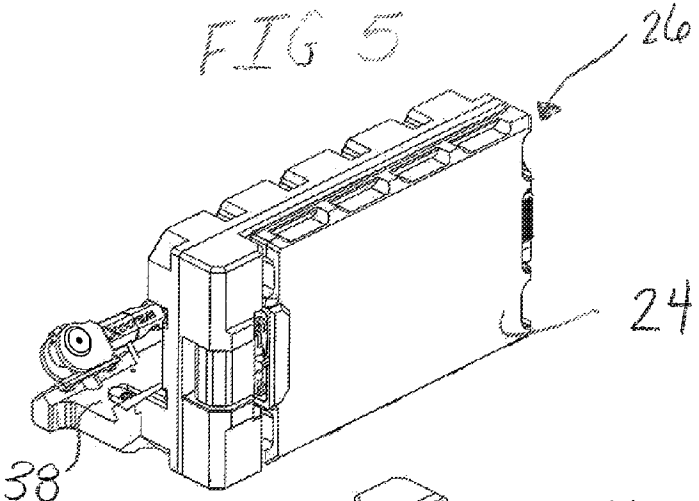
FIG. 5 is a right isometric view of a closed video display module.
Figure 4:
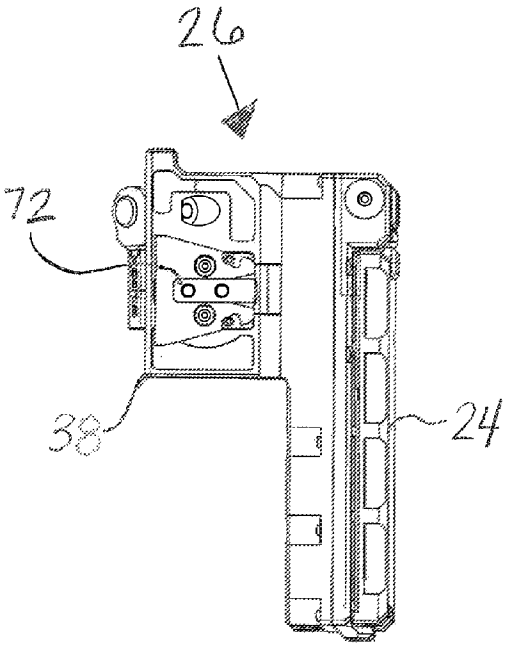
FIG. 4 is a bottom view of a closed video display module.

Referring now to FIGS. 4-6 and 8, the preferred embodiment of video display module 26 in accordance with the present disclosure includes a video control panel 22 (see FIG. 8), a video display screen 24, and the video display mounting member 38. The video display module 26 includes a processing unit for processing and outputting the displayed images. The display mounting member 38 attaches the video display module 26 to the floating rail system 12 and includes electrical contacts which provide the means to power the display module 26 by power supply 28. Power supply 28 may be mounted directly onto the mounting foot 69*a* of display mounting member 38 or may be mounted directly onto the floating rail system 12 through the use of an appropriate mounting adapter with rail grabber. When connected directly, power is provided to the display module 26 via transfer contacts on the foot 69*a* which are coupled to the power contacts on the shoe 68 of power supply 28. When connected indirectly, power is supplied through power conductors on the floating rail 12, as shown and described in U.S. patent application Ser. No. 11/972,426. The display screen 24 portion of the video display module 26 is hingedly or pivotally mounted to the control panel portion and folds flat when not in use as seen in FIGS. 4-6. In a preferred embodiment, the display 24 is automatically powered off when the display screen 24 is switched to the closed position.

Figure 8:
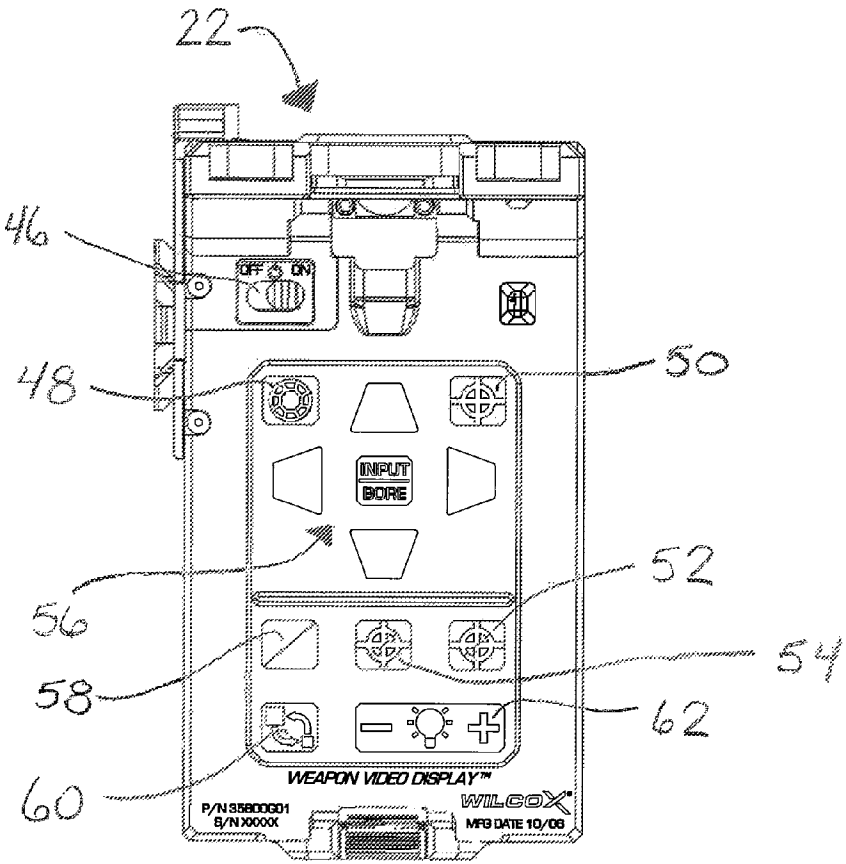
FIG. 8 is a front view of the video control panel of the video display module.
Figure 9:
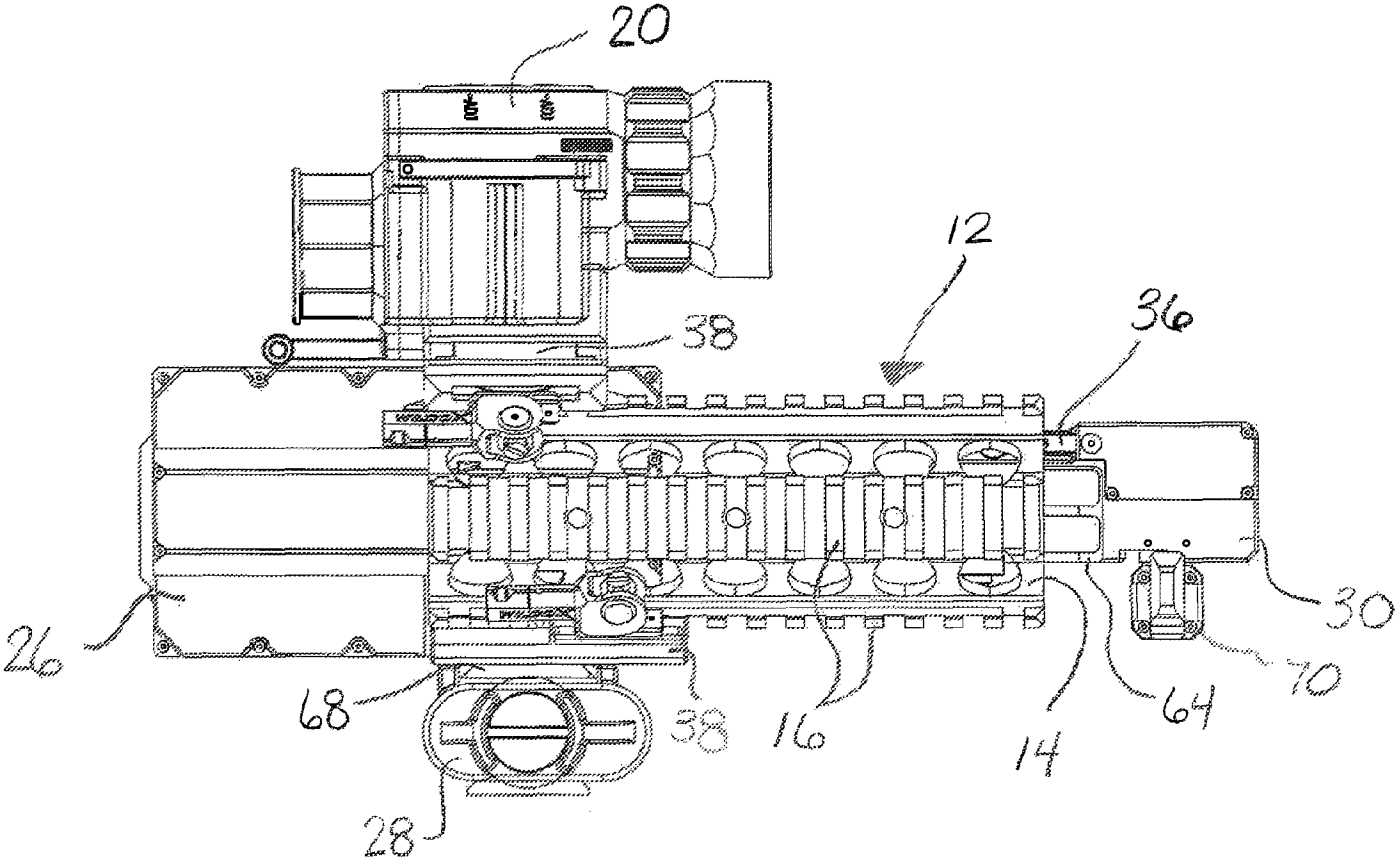
FIG. 9 is a left view of the floating rail system with a thermal sight, left and right rotating camera, power supply, and video display module attached.

Video display module 28 contains a video control panel 22 to enable the operator to control the video display, such as alternates between the left and right rotating camera and the thermal sight. Video control panel 22 is shown in FIG. 8 and includes a main power button 46 for power cycling the video module 26 and a camera select button 48 to toggle between the thermal sight 20 and the left and right camera 30, that is, by selecting between video input at the connector 39 or 40. A reticle style select button 50 is used to select the type of reticle, such as cross hairs or other target designator. The reticle color select button 52 and reticle intensity select button 54 are provided to select the color and intensity, respectively, of the graphically superimposed and displayed reticle. The cross hairs allow the operator to accurately aim the weapon and a bore sight keypad 56 is provided to align the on-screen position of the reticle with the bore of the firearm. The bore sight keypad 56 includes up, down, left and right bore sight keys for adjusting the on-screen position of the reticle during bore sight calibration in order to ensure that the firearms actual shots line up with the superimposed reticle position on the display screen image.

It will be recognized that the reticle only needs to be superimposed on the video signal receiver at one of the two input connectors 39 and 40. Since the optical axis of the left and right camera is variable, it will not necessarily be aligned with the barrel of the firearm and thus, a reticle superimposed on the left and right camera image will not necessarily be aligned with the barrel of the firearm.

A black hot/white hot image select button 58 is provided to invert the image from the thermal sight. A digital zoom button 60 is provided to digitally enlarge or zoom the displayed image. A display brightness control 62 is provided to adjust the brightness of the display. In a preferred embodiment, a photo sensor may be coupled to display brightness control circuitry to automatically adjust the screen brightness, e.g., by adjusting an LCD screen backlight, in accordance with the sensed ambient light. For example, it may be desirable to increase the display screen brightness under bright lighting conditions and reduce screen brightness under low light conditions. This automatic setting could be overridden by using the display brightness control 62 on the video control panel 22. The weapon video display module 26 herein thus allows the operator to aim at targets while remaining covered and concealed.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation.

Having thus described the preferred embodiments, the invention is now claimed to be:

1. A modular video display system for mounting on a weapon of a type having a barrel and a mounting rail system, said modular video display system comprising:

a first camera for generating a first video signal;

a first fastener connected to said first camera, said first fastener for removably attaching said first camera to a first position on said mounting rail system;

said first camera having an optical axis which is parallel to the barrel of the weapon when the first camera is attached to the first position on the mounting rail system;

a second camera for generating a second video signal;

a second fastener connected to said second camera, said second fastener for removably attaching said second camera to a second position on said mounting rail system, the second position being different from the first position;

said second camera having an optical axis and being pivotable between a first pivoted position and a second pivoted position, wherein the optical axis of the second camera extends in a first direction which is generally perpendicular to the barrel of the weapon when the second camera is attached to the weapon and pivoted to the first pivoted position and a second direction which is opposite the first direction when the second camera is attached to the weapon and pivoted to the second pivoted position;

a display module removably attachable to the weapon and including a video display screen, said display module adapted to selectively receive the first video signal via a first transmission link between the first camera and the video display module and the second video signal via a second transmission link between the second camera and the video display module for display on the video display screen;

a third fastener connected to said display module, said third fastener for removably attaching said display module to a third position on said mounting rail system which is different from the first position and the second position; and a power supply electrically coupled to said first camera, said second camera, and said display module.

2. The modular video display system of claim 1, wherein said first camera is selected from a thermal sight and a visible light-sensitive camera.

3. The modular video display system of claim 2, wherein said visible light-sensitive camera is selected from a low lux camera to allow for imaging in low light conditions and a daytime camera to allow for imaging in daylight conditions.

4. The modular video display system of claim 1, wherein said first camera is a thermal sight and said second camera is a visible light-sensitive camera.

5. The modular video display system of claim 4, wherein second camera is selected from a low lux camera to allow for imaging in low light conditions and a daytime camera.

6. The modular video display system of claim 1, further comprising:

a video recorder for recording one or both of said first video signal and said second video signal.

7. The modular video display system of claim 1, further comprising:

said display module including a display control panel for controlling operation of the display module.

8. The modular weapon video display system of claim 7, wherein said video display module includes a housing having said video control panel therein and further wherein said video display screen is pivotable about a pivot axis between a first, closed position and a second, viewable position.

9. The modular weapon video display system of claim 8, wherein the display screen is powered off automatically when the display screen is moved to the closed position.

10. The modular video display system of claim 7, further comprising any one or more of:

a reticle style button on said display control panel for selecting a type of reticle to be displayed on the video display screen;

a reticle color select button on said display control panel for selecting the colors of the reticle to be displayed on the video display screen;

a reticle intensity select button for selecting the intensity of the reticle to be displayed on the video display screen;

a bore sight keypad, for adjustment of a screen portion of the reticle to be displayed on the video display screen;

a black hot and white hot image select button for inverting a thermal image displayed on the video display screen;

a digital zoom button for enlarging video image displayed on the video display screen; and one or more display brightness control buttons for controlling the brightness of the video display screen.

11. The modular video display system of claim 1, further comprising:

a photo sensor located on said display module for sensing ambient light; and display brightness control circuitry to automatically adjust the video display screen brightness based on sensed ambient light.

12. The modular video display system of claim 11, further comprising:

one or more display brightness control buttons operatively coupled to said display brightness control circuit to selectively adjust the brightness of the video display; and said one or more display brightness control buttons overriding the video display screen brightness adjusted in response to ambient light sensed by the photo sensor.

13. The modular video display system of claim 1, further comprising:

said power supply module including a self-contained housing shell and an electrical connector on an exterior surface of the housing shell, said electrical connector removably attachable to a mating electrical connector on said display module.

14. The modular weapon video display system of claim 1, wherein said mounting rail system includes a plurality of elongate accessory mounting rails attached to a chassis of said weapon.

15. The modular weapon video display system of claim 14, wherein said power supply module is electrically connected to one of said elongate accessory mounting rails.

16. The modular weapon video display system of claim 15, wherein said first camera, said second camera, and said display module are each electrically connected to one of said plurality of elongate accessory mounting rails and wherein at least one of said first camera, said second camera, and said display module receive power through said mounting rail system.

17. The modular weapon video display system of claim 1, wherein said second camera is located at a fore-end portion of the weapon, thereby enabling an operator to look around corners and over obstacles while remaining covered.

* * * * *